US005972131A

United States Patent [19]

Asada et al.

[11] Patent Number: 5,972,131

[45] Date of Patent: Oct. 26, 1999

[54] AG-CU ALLOY FOR A SLIDING CONTACT

[75] Inventors: Takao Asada, Hiratsuka; Keiji Nakamura; Isao Shibuya, both of Motono-mura; Toshiya Yamamoto, Hiratsuka; Tetsuya Nakamura, Hiratsuka; Kiyoshi Nakama, Hiratsuka, all of Japan

[73] Assignees: Tanaka Kikinzoku Kogyo K.K.; Mabuchi Motor Co., Ltd., both of Japan

[21] Appl. No.: 08/970,535

[22] Filed: Nov. 14, 1997

Related U.S. Application Data

[63] Continuation-in-part of application No. 08/598,126, Feb. 7, 1996, abandoned, which is a continuation of application No. 08/036,553, Mar. 24, 1993, abandoned.

[30] Foreign Application Priority Data

Mar. 25, 1992 [JP] Japan ..... 4-98692
Mar. 25, 1992 [JP] Japan ..... 4-98693

[51] Int. Cl.[6] ..... C22C 05/06; C22C 05/08

[52] U.S. Cl. ..... 148/430; 148/431; 420/502; 420/504; 200/265; 200/266; 428/614; 428/615; 428/673; 428/929

[58] Field of Search ..... 148/678, 430, 148/431; 200/265–266; 420/502; 428/504, 614–615, 673, 929

[56] References Cited

U.S. PATENT DOCUMENTS 4,810,308 3/1989 Eagar et al. ..... 148/158

FOREIGN PATENT DOCUMENTS 49-23083 6/1974 Japan .
50-11924 2/1975 Japan .
59-038346 3/1984 Japan .
60-187642 9/1985 Japan .
61-006226 1/1986 Japan .
61-034148 2/1986 Japan .

*Primary Examiner*—Sikyin Ip
*Attorney, Agent, or Firm*—Klauber & Jackson

[57] ABSTRACT

An Ag—Cu alloy for a sliding contact containing:

a) 0.1 to 8.0 wt. % of Cu, based on the weight of the alloy, wherein at least 70 wt. % of the Cu contained in the alloy is solid-solubilized in an Ag-α-phase; and b) 0.1 to 4.0 wt. %, based on the weight of the alloy, of at least one metal selected from the group consisting of Ge, Ni, Sn, In, Zn, Mg, Mn, Sb, Pb and Bi.

The Ag—Cu alloy is desirably utilized to form a composite with a Cu or Cu alloy base material. Such composite has been found to be very useful for fabricating the commutator of a compact DC motor.

10 Claims, 2 Drawing Sheets

AG-CU ALLOY FOR A SLIDING CONTACT

CROSS-REFERENCE TO RELATED APPLICATIONS

This application is a continuation-in-part of application Ser. No. 08/598,126 filed Feb. 7, 1996 and now abandoned which in turn is a continuation of application Ser. No. 08/036,553, filed Mar. 24, 1993 abandoned.

BACKGROUND OF THE INVENTION

The present invention relates to an Ag—Cu alloy for a sliding contact as well as to a composite of a Cu or Cu alloy base material and the Ag—Cu alloy and to a compact DC motor employing as a commutator such composite.

While Ag—Cu alloys have been heretofore employed as materials for a sliding contact, the hardening of a solid solution is not sufficiently realized because the metallurgical structure is not sufficiently controlled and especially since Cu atoms are not completely solid-solubilized in an Ag-α-phase. The material for a sliding contact prepared from prior art Ag—Cu alloys is therefore softer and is subject to rapid abrasion because of its insufficient abrasion resistance at the time of sliding due to the unevenness of the metallurgical structure at the time of its manufacture. In case of a compact DC motor employing a commutator manufactured with such prior art material, abrasion is caused by the sliding with brush contact to produce abrasion powder which is responsible for making a noise.

SUMMARY OF THE INVENTION

The present invention has been made to overcome the above disadvantages.

An object of the present invention is to provide a material processed by a solid solution treatment which may be utilized for a sliding contact which will lower the production of abrasion powder to depress the generation of a noise.

A first aspect of the present invention is a material for a sliding contact which comprises an Ag—Cu alloy containing 0.1 to 8 wt. % of Cu, based on the weight of the alloy in which not less than 70% of all the Cu contained in the alloy is solid-solubilized in an Ag-α-phase, and the alloy further contains 0.1 to 4.0 wt. %, based on the weight of the alloy, of one or more metals which may be Ge, Ni, Sn, In, Zn, Mg, Mn, Sb, Pb or Bi.

A second aspect of the present invention pertains to a process of preparing the material for the sliding contact, i.e. the Ag—Cu alloy described above, which comprises keeping an Ag—Cu alloy in a temperature range from a solubility curve temperature to a solid phase line temperature in an Ag—Cu binary constitutional diagram, rapidly cooling the composition and thereafter cold-working the composition at a reduction in area of not less than 30%.

Since the Cu in the Ag—Cu alloy is solid-solubilized in the Ag-α-phase, the hardness of the solid solution obtained therefrom is significantly sufficiently elevated. Accordingly, the abrasion accompanied with softening occurring during the sliding is significantly decreased.

In contradistinction to the process of the present invention, the Ag-α-phase of an Ag—Cu alloy prepared through a conventional solid solution treatment is likely to be largely recrystallized such that unevenness of the surface results after bending.

According to the processes of the present invention for preparing material for a sliding contact, the structure obtained at a high temperature can be maintained without relaxation after cooling and, by utilizing the following cold-working process, the cooled material can be hardened to reduce the production of surface unevenness and to increase abrasion resistance. If the commutator of a micromotor, e.g., a compact DC motor, is manufactured with the material of this invention, the abrasion resulting from sliding with a brush contact can be decreased to lower the noise generated due to abrasion powder.

DETAILED DESCRIPTION OF THE INVENTION

The invention, in its several aspects, pertains to an Ag—Cu alloy for a sliding contact as well as composites of such alloy and a Cu or Cu alloy base material and commutators for compact DC motors prepared from such composites.

The Ag—Cu alloy for the sliding contact contains:

a) 0.1 to 8.0 wt. % of Cu, based on the weight of the alloy, wherein at least 70 wt. % of the Cu contained in the al loy is solid-solubilized in an Ag-α-phase; and b) 0.1 to 4.0 wt. %, based on the weight of the alloy, of at least one metal selected from the group consisting of Ge, Ni, Sn, In, Zn, Mg, Mn, Sb, Pb andBi.

Preferably, the metal in the alloy consists of Zn and Ni. Two particularly preferred alloys are those wherein the Zn and Ni content are 0.1 to 2.0 wt. %, based on the weight of the alloy and 2.1 to 4.0 wt. %, based on the weight of the alloy.

The composite for a sliding contact comprises a Cu or Cu alloy base material having embedded the Ag—Cu alloy on at least a part of its surface thereof. Preferably, the composite is such that at least part of the Ag—Cu alloy is covered with Au or an Au alloy. Particularly preferred composites are those wherein the metals in the Ag—Cu alloy consist of 0.1 to 4.0 wt. %, based on the weight of the alloy, of Zn and Ni.

It has been discovered that when the Ag—Cu alloy contains 0.1 to 2.0 wt. %, based on the weight of the alloy of Zn and Ni, the resistance to wear and contact resistance will be balanced in an ideal manner because the Zn is solid-solubilized in an Ag-α-phase and the Ni is finely dispersed in the entire alloy. More particularly, it appears that an extremely thin film of ZnO is formed on the surface of the alloy, thereby providing good lubricity. If the thin film of ZnO is intermittently broken in sliding, fine particles of Ni will maintain the lubricity in an auxiliary manner. Accordingly, if only Zn was present in the alloy, when the thin ZnO film is broken, the material for a sliding contact is relatively easily worn. However, if both Zn and Ni are present in the alloy, the two elements act synergistically to increase resistance to wear. Furthermore, since a film of ZnO has a higher level of electrical conductivity than the of thin film of oxides of other elements, contact resistance is not increased, thereby resulting in a material for a sliding contact having better properties for a sliding contact than conventional prior art materials.

The present inventions contemplates decreasing the abrasion occurring in a side contact comprised of an Ag—Cu alloy having the composition described above. The minimum degree of abrasion can be attained if the Cu is completely solid-solubilized in the Ag-α-phase. However, even if such substantially complete solid solubilization is achieved, satisfactory abrasion resistance cannot be obtained unless the final product contains a satisfactory degree of hardness.

The present invention has been made by the present inventor considering these concepts.

Figure 1:
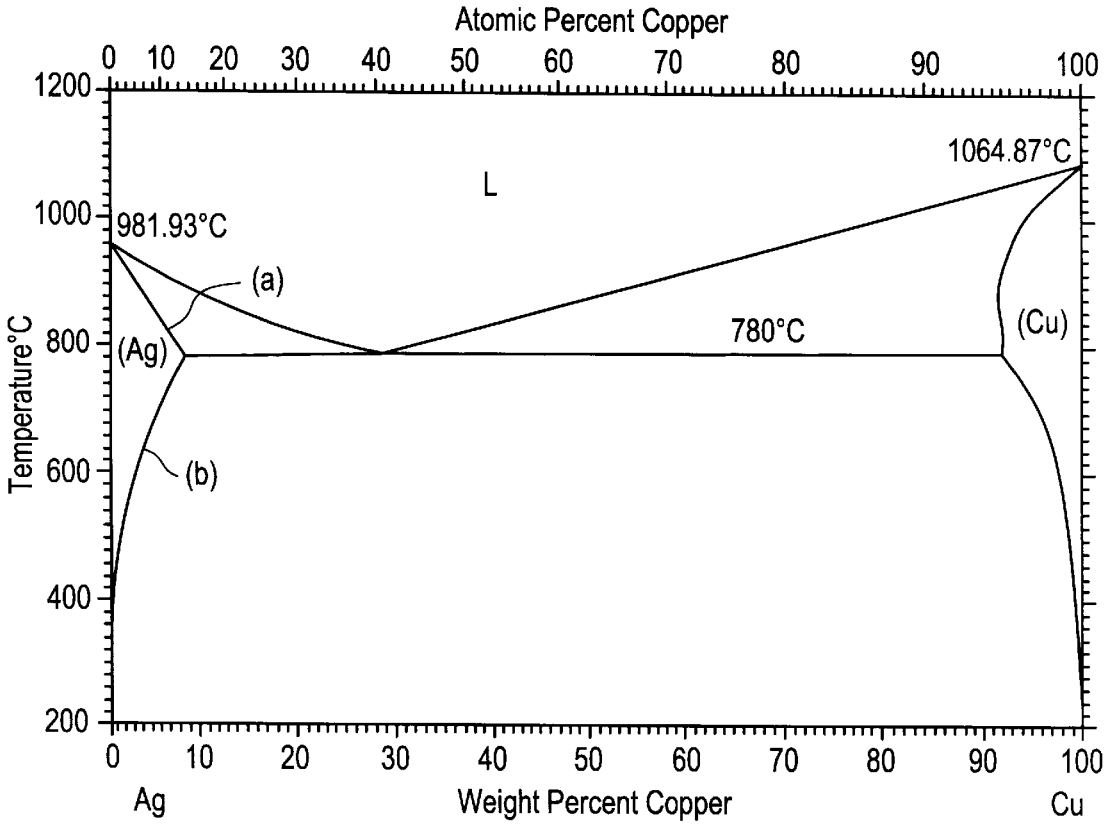
FIG. 1 is a binary alloy constitutional diagram of the Ag—Cu alloy.

In the process of the present invention, the initial Ag—Cu mixture is heated to a temperature between a solubility curve temperature to a solid phase line temperature in an Ag—Cu binary constitutional diagram. The Cu is completely solid-solubilized in an area surrounded by a spindle, a solid phase line (a) and a solubility curve (b) as shown in FIG. 1. In the case of an Ag(94)—Cu(6) alloy, for example, a temperature range in which Cu is completely solid-solubilized is 700 to 830° C. Accordingly, the temperature at which the initial mixture is heated is variable depending on the composition thereof.

The structure of the alloy is substantially maintained after cooling to an ambient temperature with minimum relaxation if the cooling is rapidly carried out.

The rapid cooling is preferably conducted by means of water or oil, and the cooling rate is usually between 25 and 250° C./second, preferably between 100 and 250° C./second. On the other hand, the cooling rate of air-cooling is usually between 10 and 100° C./minute.

Thereafter, the cooled composition is subjected to cold-working for producing hardness which decreases the surface unevenness and increases the abrasion resistance. This cold-working is wire-drawing or strip-rolling. A reduction in area resulting from such cold-working is not less than 50%. The reduction in area means the decrease of a sectional area. If a wire is drawn or a strip is rolled at a reduction in area of 50% , the sectional area of the wire or the strip becomes half the original sectional area, or the length of the wire or the strip becomes twice the original length.

In the thus-obtained alloy, not less than 70% of the Cu is solid-solubilized in the Ag. Since the weight ratio of the Cu to the entire alloy is between 0.1 and 8 wt %, the weight ratio of the Cu solid-solubilized is 0.07 to 5.6 wt. %.

The Ag-α-phase in which the Cu is solid-solubilized may be explained as follows.

The same crystal structure as that of a pure metal is called an α-phase. The pure Ag possesses a crystal structure of a face centered cubic lattice. The Ag alloyed with a small amount of Cu possesses the same face centered cubic lattice so that the Ag-α-phase in the present invention is the same crystal structure as that of the pure Ag.

EXAMPLES

The following non-limiting examples shall serve to illustrate the invention. Unless otherwise indicated to the contrary, all parts are on a weight basis.

Example I

A mixture of Ag powder and Cu powder was cast into bullet form after it was melted in a vacuum melting furnace. The bullet was extruded to produce a wire. Then, the wire was drawn at a diameter of 2.8 mm.

After the wire was kept for one hour at 750° C., it was water-cooled at a rate of 120° C./sec., and thereafter it was subject to a wire draw processing at a reduction in area of 49% to prepare material for a slide contact test.

The lattice constant of the Ag-α-phase of thus prepared material was 4.037 Å. The amount of Cu solid-solubilized was 6.6% in weight according to the Vegard rule.

A round bar of which diameter was 2 mm to be used as test material was prepared employing the above material. This round bar and another round bar consisting of Ag—Pd (50%) having the same diameter were crossed with each other, and a slide test was conducted in accordance with the following conditions. The amount of abrasion and contact resistance obtained in the slide test are shown in Table 1. The amount of abrasion was determined as a volume of slide traces. The contact resistance was a maximum value during the test.

Test Conditions:

| | |
|---|---|
| Current | DC 170 Ma |
| Slide Speed | 20 mm/sec |
| Load | 25 g |
| Test Duration | 333 min. |
| Temperature | 25° C. |
| Humidity | 50% RH |

TABLE 1

| | Composition (% in weight) | | | | | | Amount of Abrasion | Contact Resistance |
|---|---|---|---|---|---|---|---|---|
| | Ag | Cu | Cd | Pb | Sb | Zn | ($mm^3$) | (mΩ) |
| Example | | | | | | | | |
| 1 | 92.5 | 7.5 | — | — | — | — | 0.15 | 10 |
| 2 | 92 | 6 | 2 | — | — | — | 0.08 | 12 |
| 3 | 93 | 6 | — | 1 | — | — | 0.12 | 14 |
| 4 | 92 | 6 | — | — | 2 | — | 0.20 | 11 |
| 5 | 92 | 6 | — | — | — | — | 0.25 | 17 |
| Comp. Ex. | | | | | | | | |
| 1 | 92.5 | 7.5 | — | — | — | — | 0.45 | 42 |
| 2 | 92 | 6 | 2 | — | — | — | 0.32 | 35 |

Examples 2 to 5

The material for a sliding contact was prepared and tested under the same conditions as those of Example 1 except that a small amount of a third metal, that is, Cd (Example 2), Pb (Example 8), Sb (Example 4) or Zn (Example 5) as shown in Table I, was added to the initial mixture. The amount of abrasion and contact resistance obtained in the slide test are shown in Table 1.

Comparative Example 1

The material for a sliding contact was prepared and tested under the same conditions as those of Example 1 except that the wire was kept for one hour at 550° C., and then air-cooled at a rate of 50° C./sec., and thereafter subjected to a wire draw processing to prepare material for a slide contact test. The amount of abrasion and contact resistance obtained in the slide test are shown in Table 1.

The lattice constant of the Ag-α-phase of thus-prepared material was 4.063 Å. The amount of Cu solid-solubilized was 3% in weight according to the Vegard rule.

Comparative Example 2

The material for a sliding contact was prepared and tested under the same conditions as those of Comparative Example 1 except that a small amount of Cd was added to the initial mixture. The amount of abrasion and contact resistance obtained in the slide test are shown in Table 1.

Example 6

A mixture of Ag powder, Cu powder and third metal (Ge) powder was cast into bullet form after it was melted in a vacuum melting furnace. The bullet was extruded to produce a wire. Then, the wire was drawn at a diameter of 4.0 mm.

After the wire was kept for 30 minutes at 700° C., it was water-cooled at a rate of 110° C./sec., and thereafter it was subject to a wire draw processing at a reduction in area of 75% to prepare material for a sliding contact.

The lattice constant of the Ag-α-phase of the thus-prepared material was 4.050 Å. The amount of Cu solid-solubilized was 4.8% in weight according to the Vegard rule.

The amount of abrasion and the contact resistance obtained in the same slide test as that of Example 1 are shown in Table 2.

TABLE 2

| | Composition (% in weight) | | | Amount of Abrasion | Contact Resistance |
|---|---|---|---|---|---|
| | Ag | Cu | Third Metal | ($mm^3$) | (mΩ) |
| Example | | | | | |
| 6 | balance | 6 | Ge, 0.5 | 0.10 | 12 |
| 7 | balance | 6 | Ni, 0.2 | 0.12 | 14 |
| 8 | balance | 6 | Sn, 0.5 | 0.30 | 9 |
| 9 | balance | 6 | In 0.5 | 0.32 | 7 |
| 10 | balance | 6 | Zn, 0.5 | 0.25 | 15 |
| 11 | balance | 6 | Mg, 0.3 | 0.18 | 10 |
| 12 | balance | 6 | Mn, 0.5 | 0.27 | 8 |
| 13 | balance | 6 | Sb, 0.5 | 0.15 | 17 |
| 14 | balance | 6 | Pb, 0.5 | 0.25 | 9 |
| 15 | balance | 6 | Bi, 0.2 | 0.20 | 16 |
| 16 | balance | 6 | Ge, 0.5 | 0.38 | 4 |
| 17 | balance | 6 | Ge, 5 | 0.20 | 57 |

Examples 7 to 15

The material for a sliding contact was prepared and tested under the same conditions as those of Example 6 except that the third metal was Ni (Example 7), Sn (Example 8), In (Example 9) , Zn (Example 10) , Mg (Example 11) , Mn (Example 12), Sb (Example 13), Pb (Example 14) or Bi (Example 15) as shown in Table 2. The amount of abrasion and contact resistance obtained in the slide test are shown in Table 2.

Examples 16 and 17

The material for a sliding contact was prepared and tested under the same conditions as those of Example 6 except that the amount of Ge added to the initial mixture was changed, that is, 0.05% in weight (Example 16) and 5% in weight (Example 17). The amount of abrasion arid contact resistance obtained in the slide test are shown in Table 2.

Example 18

Example 6 was repeated except that the third metal consisting of 1% Zn and 0.5% Ni was used instead of Ge. The alloy was subjected to the same type of processing as in Example 6 and the following results were obtained in the course of the slide test:

| Wt. % Ag | Wt. % Cu | Third Metal | Amount of Wear | Contact Resistance |
|---|---|---|---|---|
| Balance | 6 | 1% Zn and 0.5% Ni | 0.06 $mm^3$ | 8 mΩ |

Example 19

Example 18 was repeated except that the third metal consisted of 3% Zn and 0.5% Ni. The following results were obtained in the course of the slide test:

| Wt. % Ag | Wt. % Cu | Third Metal | Amount of Wear | Contact Resistance |
|---|---|---|---|---|
| Balance | 6 | 3% Zn and 0.5% Ni | 0.05 $mm^3$ | 8 mΩ |

The results obtained with various alloys supported the validity of a range of 2.1 to 4.0 wt. %, based on the weight of the alloy, for the amount of Zn and Ni. It was found that when the amount of Zn and Ni exceeded 4.0 wt. %, both the amount of wear and the contact resistance increased to undesirable levels. It thus appears that the most desirable level of Zn and Ni as the third metal in the Ag—Cu alloy is in the range of 0.1 to 4.0 wt. %, based on the weight of the alloy.

Examples 20–29

Example 20 pertains to the use of a composite material for a sliding contact in the commutator of a micromotor wherein the composite material was obtained by processing an Ag—Cu (6 wt. %) alloy under the conditions of Comparative Example 1; the characteristic lifetime of the composite material is shown in Table 3.

Examples 21–29 pertain to the use of composite materials for commutators wherein a third metal is present in the alloy as set forth in Table 3.

The tests were carried out by utilizing the composite materials as cladding for a commutator in a micromotor. The motor was continuously started in order to examine a characteristic lifetime period until such time that the motor was no longer rotatable. Such lifetime period is indicative of the production of wear particles and was derived using Weibull Probability Papers relative to each period.

More particularly, the composite materials consisted of a base Cu alloy in which were embedded the different Ag—Cu alloys set forth in Table 3. The resultant composite materials were processed into triode commutators having an external diameter of 3.3 mm and a length of 4.0 mm and the resultant commutators were then incorporated into compact DC motors. The test conditions were as follows:

| | |
|---|---|
| Test Temperature | room temperature |
| Humidity | 50% relative humidity |
| Load | 30 g-cm |
| Electric Current | 200 mA |
| Revolutions Per Minute | 4,500 |
| Mode | ON for 2 seconds;<br>OFF for 2 seconds<br>(forward and reverse movements are repeatedly carried out) |

When the results set forth in Table 3 are examined, it is clear that in comparison to a conventional composite material (Example 20), the composite materials of the invention (Examples 21–29) offer distinct advantages in respect to characteristic lifetime periods. Note that the best results are those of Examples 23 and 24 in which the third metal was Zn and Ni within the desirable range of 0.1 to 4 wt. %, based on the weight of the alloy.

TABLE 3

| | Composition, in weight % | | | | | | | | Characteristic Lifetime |
|---|---|---|---|---|---|---|---|---|---|
| Example | Ag | Cu | Zn | Ni | Sb | Mn | Mg | Sn | Period, hr |
| 20 | 94.0 | 6 | — | — | — | — | — | — | 200 |
| 21 | 93.0 | 6 | 1.0 | — | — | — | — | — | 650 |
| 22 | 93.5 | 6 | — | 0.5 | — | — | — | — | 900 |
| 23 | 92.5 | 6 | 1.0 | 0.5 | — | — | — | — | 1050 |
| 24 | 90.5 | 6 | 3.0 | 0.5 | — | — | — | — | 1070 |
| 25 | 90.0 | 6 | 4.0 | 1.0 | — | — | — | — | 800 |
| 26 | 93.5 | 6 | — | — | 0.5 | — | — | — | 320 |
| 27 | 93.5 | 6 | — | — | — | 0.5 | — | — | 300 |
| 28 | 93.5 | 6 | — | — | — | — | 0.5 | — | 900 |
| 29 | 93.5 | 6 | — | — | — | — | — | 0.5 | 450 |

Example 30

Figure 2:
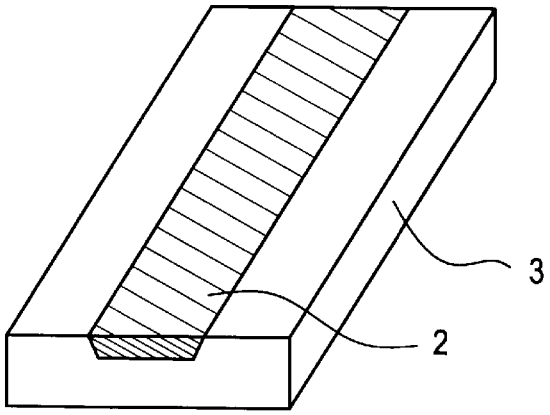
FIG. 2 is a perspective view of a composite material containing the Ag—Cu alloy.

In general, the Ag—Cu alloys the present invention are not suitable as such for use in a commutator of a micromotor because such alloys do not possess the requisite spring action. Therefore, these alloys are utilized in the form of a composite in which the alloy is embedded in at least a part of the surface of a suitable base material such as Cu or a Cu alloy. Such a composite is illustrated in FIG. 2 in which Cu and/or a Cu alloy are employed as the base material 3 in which the AG—Cu alloy of the present invention 2 is embedded therein. The composite may be obtained by rolling alloy 2 positioned on the surface of base material 3. The resultant composite has a total thickness of 0.3 mm and a width of 19 mm, including approximately 20 $\mu$m thickness of the alloy for the sliding contact. Such composite possesses the requisite degree of spring action required for use as a commutator. It should be noted that the thickness of the alloy embedded in the base material may be adjusted as desired depending on the type of motor in which the commutator is to be utilized.

Example 31

Desirably, the surface of the composite , i.e. the Ag—Cu alloy embedded in the Cu or Cu alloy base material, is protected from corrosion by covering such surface with a layer of a stable Au or Au alloy. Although the Au or Au alloy is somewhat expensive, it nevertheless provides good corrosion resistance as well as good contact resistance.

Figure 3A:
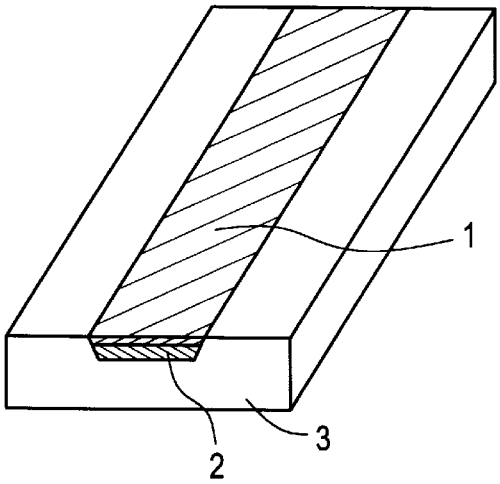
FIG. 3*a* is a perspective view of a composite material containing the Ag—Cu alloy.

As shown in FIG. 3*a* and *b*, Cu or a Cu alloy is employed as base material 3 for the composite. The Au or Au alloy layer 1 is preliminarily joined to the Ag—Cu alloy layer 2 and the resultant joined product is positioned on and embedded in base material 3. Typically, the composite will have a total thickness of 0.3 mm and a width of 19 mm; the thickness of the Ag—Cu alloy will be approximately 20 $\mu$m and the thickness of the Au or Au alloy will be approximately 5 $\mu$m.

Figure 3B:
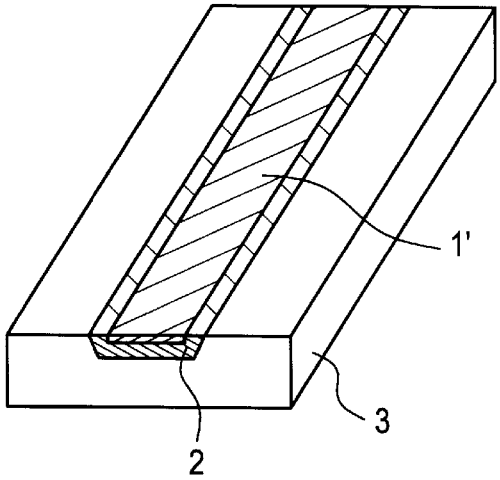
FIG. 3*b* is a perspective view of a composite material containing the Ag—Cu alloy.

The surface of the Ag—Cu alloy 2 may be fully covered with the Au or Au alloy layer 1 as shown in FIG. 3*a*. Alternatively, as shown in FIG. 3*b*, only a required portion 1' of the surface of the Ag—Cu alloy 2 may be covered with the Au or Au alloy.

What is claimed is:

1. A sliding contact material for a commutator for a motor with a DC brush consisting of:

a) 0.1 to 8.0 wt. % of Cu, based on the weight of the alloy, wherein at least 70 wt. %. of the Cu contained in the alloy is solid-solubilized in an Ag-α-phase; and b) 0.1 to 2.0 wt. %, based on the weight of the alloy, of Zn and Ni.

2. A composite for a sliding contact comprising a Cu or Cu alloy base material, said base material having embedded on at least a part of its surface thereof the material of claim 1.

3. A composite according to claim 2 wherein at least part of the material on at least a part of the surface thereof is covered with Au or an Au alloy.

4. A compact DC motor which employs as a commutator the composite of claim 3.

5. A compact DC motor which employs as a commutator the composite of claim 2.

6. A sliding contact material for a commutator for a motor with a DC brush consisting of:

a) 0.1 to 8.0 wt. % of Cu, based on the weight of the alloy, wherein at least 70 wt. % of the Cu contained in the alloy is solid-solubilized in an Ag-α-phase; and b) 2.1 to 4.0 wt. %, based on the weight of the alloy, of Zn and Ni.

7. A composite for a sliding contact comprising a Cu or Cu alloy base material, said base material having embedded on at least a part of its surface thereof the of claim 6.

8. A composite according to claim 7 wherein at least part of the material on at least a part of the surface thereof is covered with Au or an Au alloy.

9. A compact DC motor which employs as a commutator the composite of claim 8.

10. A compact DC motor which employs as a commutator the composite of claim 7.

* * * * *